United States Patent [19]

Uchida et al.

[11] Patent Number: 4,873,185

[45] Date of Patent: Oct. 10, 1989

[54] ONE-COMPONENT TONER FOR DRY ELECTROPHOTOGRAPHY CONTAINING METAL COMPLEX AS CHARGE CONTROL AGENT

[75] Inventors: Mitsuru Uchida, Chohfu; Satoshi Yasuda, Matsudo; Tetsuya Kuribayashi, Tokyo, all of Japan

[73] Assignee: Canon Kabushiki Kaisha, Tokyo, Japan

[21] Appl. No.: 69,498

[22] Filed: Jul. 2, 1987

[30] Foreign Application Priority Data

Jul. 3, 1986 [JP] Japan ..... 61-155145

[51] Int. Cl.[4] ..... G03G 9/14

[52] U.S. Cl. ..... 430/903; 430/110; 430/106.6

[58] Field of Search ..... 430/110, 903, 106.6

*Primary Examiner*—J. David Welsh

*Attorney, Agent, or Firm*—Fitzpatrick, Cella, Harper & Scinto

[57] ABSTRACT

A toner for dry electrophotography comprises a binder resin, a metal complex compound (A) of an aromatic hydroxycarboxylic acid having a lipophilic group, and a metal complex salt-type monoazo dye (B) having a hydrophilic group. The compound (A) functions to enhances the negative triboelectric chargeability of the toner, and the dye (B) functions to leak an excessive charge of the toner, so that the toner is caused to have a uniform and sharp triboelectric charge distribution. As a result, the toner involves little liability of causing "tailing", an irregularity caused by undesirable toner scattering.

15 Claims, 1 Drawing Sheet

ONE-COMPONENT TONER FOR DRY ELECTROPHOTOGRAPHY CONTAINING METAL COMPLEX AS CHARGE CONTROL AGENT

FIELD OF THE INVENTION AND RELATED ART

The present invention relates to a dry toner for use in dry electrophotography. More specifically, the present invention relates to a dry toner preferably used in a copying machine having a hot roller fixer whereby a transfer paper having a toner image thereon is passed through two rotating rollers to fix the toner image by the action of heat and pressure.

Conventionally, in the electrophotographic process using a dry toner, an electrostatic latent image is ordinarily developed with a toner having a triboelectric charge, the resulting toner image is transferred onto a transfer paper, and the transfer paper having the toner image thereon is passed through a fixer to fix the toner image on the transfer paper. In the fixing step of such an electrophotographic process, an abnormal phenomenon called "tailing" occurs in some cases. The tailing phenomenon includes "flow-tailing" that the toner forming a copied image or line is partly drifted backwards, i.e., in the reverse direction with respect to the transfer paper movement (see FIG. 2 in comparison with a normal image in FIG. 1), and "explosion-tailing" that toner constituting a part of a copied image is wholly scattered backwards to remove or cut the copied image (see FIG. 3).

The tailing phenomenon is liable to be caused by a dry toner, and is particularly liable to occur in a copying machine using a one-component type toner (especially, one-component magnetic toner which is provided with a triboelectric charge through friction with a sleeve and without using carrier particles.

The tailing remarkably degrades the quality of images formed by the dry electrophotographic process, so that the prevention thereof has been one of the most important problems involved in the electrophotographic process.

It is considered that the tailing phenomenon is caused by nonuniform triboelectric charge provided to toner particles. More specifically, toner particles having a broad distribution of triboelectric charges include a considerable amount of toner particles having a small triboelectric charge (i.e., particles having a small attachment force onto a transfer paper). For this reason, there is presumably a tendency that the toner particles having a small triboelectric charge are released from the transfer paper in the transfer step due to various forces, such as pressure exerted when the transfer paper is passed through fixing rollers, wind force, impacting force, and repulsion caused by charge through friction with rollers. As a result, a conventional toner presumably has a tendency to cause the above-mentioned release phenomenon driftedly at the whole or a part of a letter or line image (flow-tailing) or intensively at a part of a letter or line image (explosion-tailing).

It has been practiced to add a charge control agent in order to control the chargeability of a toner. For example, U.S. Pat. No. 4,206,064 discloses metal complexes of salicylic acid and an alkylsalicylic acid as a substantially colorless charge control agent which has been proposed to substitute for densely colored metal-containing monoazo dyes as disclosed in Japanese Pat. Publn. No. 26478/1970. A toner containing the metal complex is markedly improved in chargeability compared with a toner not containing the metal complex and also has a sharp distribution of triboelectric charges. However, such a toner containing the metal complex can still cause "tailing" under some fixing conditions, so that a toner having further improved electrophotographic characteristics including freeness from such a trailing phenomenon.

SUMMARY OF THE INVENTION

An object of the present invention is to provide a dry toner capable of preventing an image defect called "tailing" generated in the fixing step of a dry electrophotography.

Another object of the present invention is to provide a dry toner excellent in developing characteristic and transfer characteristic and also capable of providing images with a high density.

A further object of the present invention is to provide a one-component magnetic toner with markedly reduced tendency of causing a tailing phenomenon.

According to the present invention, there is provided a dry electrophotographic toner, comprising: a binder resin, a metal complex compound (A) of an aromatic hydroxycarboxylic acid having a lipophilic group, and a metal complex salt-type monoazo dye (B) having a hydrophilic group.

BRIEF DESCRIPTION OF THE DRAWINGS

FIGS. 1, 2 and 3 are photographs of fixed toner images, wherein

FIG. 1 shows a good fixed image substantially free of tailing;

FIG. 2 shows a fixed image with "flow-tailing", and

FIG. 3 shows a fixed image with "explosion-tailing".

DETAILED DESCRIPTION OF THE INVENTION

Figure 1:
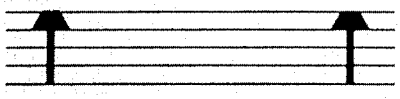
Figure 2:
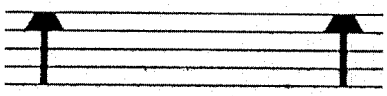
Figure 3:
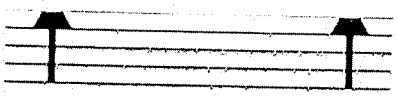

We have investigated the triboelectric characteristic of a toner containing different types of charge control agents in combination compared with that of a toner containing a single type of charge control agent. As a result, it has been found that the combination of a metal complex of a specific carboxylic acid having a lipophilic group (A) and a metal complex salt of a monoazo salt having a hydrophilic group (B) provides a remarkable effect of uniformizing triboelectric charge, and further the combination remarkably suppresses the above mentioned "tailing" phenomenon.

The reason why the toner of the present invention can prevent the tailing phenomenon is presumed as follows.

The above metal complex compound (A) and metal complex-salt type monoazo dye (B), when added separatedly into a toner in the form of particles, provide a negative charge control characteristic and generally enhances the triboelectric chargeability of the toner. When the metal complex compound (A) and the metal complex type monoazo dye (B) respectively in particulate form are copresent in a toner, the triboelectric chargeability of the toner is enhanced due to the metal complex compound (A) having a lipophilic group, and an excessively high triboelectric charge is partly neutralized and suppressed due to leakage through the hydrophilic group of the monoazo dye (B) present in the neighborhood of the metal complex compound (A), whereby the triboelectric charge densities of the individual toner particle surfaces of the respective toner particles are averaged. As a result, in the developing step, occurrence of toner particles with too small a triboelectric charge is suppressed, while an excessively large triboelectric charge is leaked, so that the toner is caused to have a uniform and sharp triboelectric distribution.

Consequently, it is presumed that in the transfer step, the electrostatic force of attachment acting between the toner image composed of toner particles having a uniform triboelectric charge distribution and the transfer paper is enhanced as a whole, so that the release of toner particles constituting the toner image from the transfer paper is suppressed to prevent the occurrence of "tailing".

The above-mentioned uniformization of triboelectric charge in the toner of the present invention also provides improved developing characteristic and transfer characteristic, which lead to an increased image density of toner image.

The lipophilic group in the metal complex compound (A) is a non-polar atomic group having very little affinity with water and a large affinity with oil. Examples of the lipophilic group include aliphatic hydrocarbon groups having preferably 1–12 carbon atoms, more preferably 4–10 carbon atoms; alicyclic hydrocarbon groups having preferably 5–12 carbon atoms, more preferably 6–8 carbon atoms; and aromatic hydrocarbon groups having preferably 6–12 carbon atoms, more preferably 6–10 carbon atoms. It is preferred that the lipophilic group is free of a hydrophilic substituent.

The lipophilic group of the metal complex compound (A) preferably comprises an aliphatic hydrocarbon group, particularly an alkyl group, directly attached to the aromatic cyclic (monocyclic or polycyclic) hydrocarbon group of the metal complex compound (A). In the metal complex compound (A) having such a lipophilic group, the aromatic hydroxycarboxylic acid as a ligand may preferably comprise a benzene ring or a naphthalene ring and be bound to the metal atom with the carboxylic group and the hydroxyl group. The metal complex compound (A) may preferably be one having a ligand represented by the following partial structural formula:

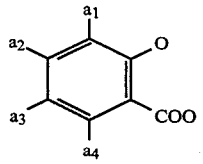

wherein $a_1$, $a_2$, $a_3$ and $a_4$ may be hydrogen atom or lipophilic group and can form a ring through their combination.

The hydrophilic group of the monoazo dye (B) is a polar atomic group having a strong interaction with water. Principal examples of the hydrophilic group include $-SO_3H$, $-SO_3M$, $-COOM$, $-N^{\oplus}(R)_3X^{\ominus}$, $-COOH$, $-NH_2$, $-CN$, $-OH$, $-NHCONH_2$, $-X$, and $-NO_2$, wherein R denotes an alkyl group, M denotes an alkali metal or $-NH_4$, and X denotes a halogen. Preferred examples of the hydrophilic group include halogen (—X), carboxyl (—COOH), hydroxyl (—OH), nitro ($-NO_2$), sulfo ($-SO_3H$), and sulfamide ($-SO_2NH_2$).

The metal complex salt type monoazo dye (B) having a hydrophilic group may preferably be one having a benzene ring or a naphthalene ring in its ligand structure and having an O,O'-dioxyazo structure.

A particularly preferred class of the monoazo dye (B) is one having a ligand represented by the following partial structural formula:

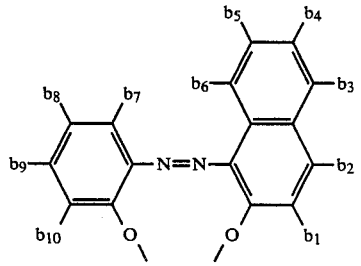

wherein $b_1$–$b_{10}$ denote hydrogen atom or hydrophilic group.

The above-mentioned hydrophilic group may preferably be bonded to the monocyclic or polycyclic group (e.g., benzene ring or naphthalene ring) of the monoazo dye (B).

The compound (A) and the dye (B), when added separately into a toner, exhibit a negative charge-controlling characteristic. The present invention effectively utilizes the interaction of the compound (A) and the dye (B) used in combination, thereby to realize a uniform triboelectric charge distribution of the toner particles. In the toner of the present invention, it is further preferred that one or more of the following conditions (a)–(e) are satisfied in order to further enhances the effect of co-use of the compound (A) and the dye (B).

(a) The metal atoms constituting the metal complexes of the compound (A) and the dye (B) are the same. This condition is preferred because the particles of the compound (A) and the dye (B) are caused to have almost identical mutual solubility to the binder resin.

(b) The metal atom in the metal complexes is Cr. In this case, the negative chargeability of the toner is enhanced to an appropriate level.

(c) The compound (A) and the dye (B) are in the form of fine particles in order to improve the dispersibility in the binder resin. More specifically, it is preferred that they have a volume-average particle size ($d_v$) of 9.0 μm or below, and a number-average particle dize ($d_n$) of 5.0 μm or below.

(d) The compound (A) and the dye (B) have electrical resistivities on substantially the same order. More specifically, the compound (A) and the dye (B) have a ratio of volume resistivity (compound (A)/dye (B)) on the order of $10^{-3}$–$10^{3}$. In this case, thee triboelectric charge is further uniformized.

(e) The melt index (MI) of the toner is small. More specifically, it is preferred that the condition of $MI \leqq 10$, particularly $MI \leqq 5$, is satisfied. This is because the particles of the compound (A) and the dye (B) are well dispersed in the binder resin at the time of melt-kneading. The MI value used herein refers to those measured according to JIS K-7210 under the conditions of a temperature of 125° C. and a pressure of 10 Kg.

The compound (A) may preferably be a metal complex of a salicylic acid-type or a naphthoic acid-type represented by the following formulas (I)–(III).

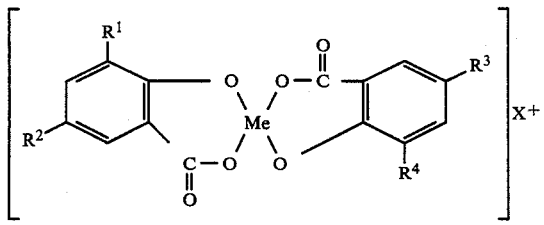

(I)

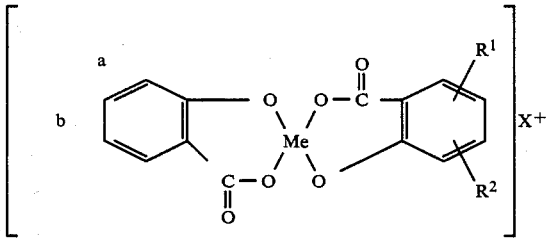

(II)

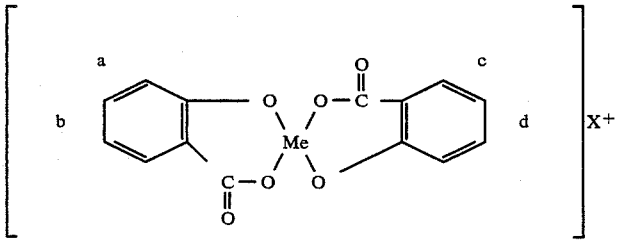

(III)

In the above formulas, $R^1$, $R^2$, $R^3$ and $R^4$ denote the same or different groups which may be hydrogen or a hydrocarbon group (alkyl group or alkenyl group) of $C_{10}$ or less provided that at least one of $R^1$–$R^4$ denotes a hydrocarbon group described above in the formula (I); a and b denote a hydrocarbon group of $C_4$–$C_9$ (preferably an alkyl group) attached to the benzene ring or capable of forming a benzene ring or cyclohexene ring. In the case where a or b forms a cyclic structure in the formula (II), the cyclic structure can further have a hydrocarbon group as described above. In the formula (III), c and d denote a hydrocarbon group (preferably an alkyl group) of $C_4$–$C_9$ attached to the benzene group or can form a benzene ring or a cyclohexene ring. In the formula (III), either one of a and b and either one of c and d forming a ring structure can further have a hydrocarbon group as described above. Further, in the above formulas, the counter ion $X^+$ may be $H^+$, $K^+$, $Na^+$, $NH_4^+$ or $Li^+$, and Me denotes Cr, Ni, Co, Cu or Zn.

As is understood from the above formulas, the ligands bound to the metal atom need not be the same. In such a case, it is required that at least one of the ligands is a ligand of an aromatic hydroxycarboxylic acid having a lipophilic group.

In the salicylic acid-type or naphtholic acid-type metal complex of the above formulas (I)–(III). The alkyl group constituting $R^1$, $R^2$, $R^3$ and $R^4$ may preferably have 5 or less carbon atoms. Particularly, a tertiary butyl group or a tertiary amyl group is preferred. More specifically, in the present invention, chromium complex of 3,5-di-tertiary butyl-salicylic acid or chromium complex of mono-tertiary butyl-salicyclic acid is particularly preferably used as the compound (A).

Particularly preferred examples of the metal complex compound (A) are those represented by the following formulas A-1 to A-3:

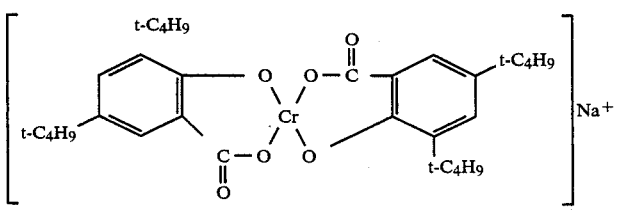

A-1

-continued

A-2

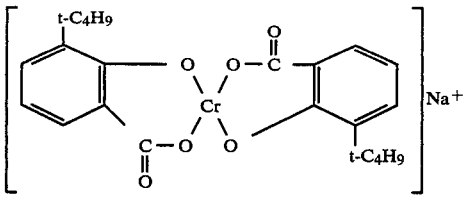

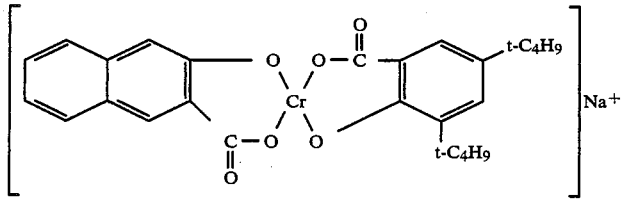

The metal complex salt-type monoazo dye (B) may be those known as charge control agents for negatively chargeable toners. Preferred classes of the monoazo dyes are metal complex salt-type monoazo dyes of the following formulas (IV) or (V) wherein coupling products of phenol or naphthol derivatives are contained as the ligands.

(IV)

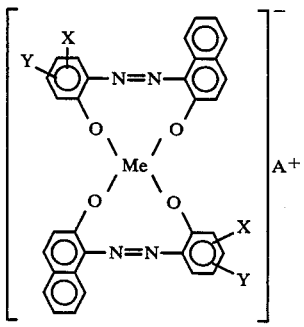

-continued (V)

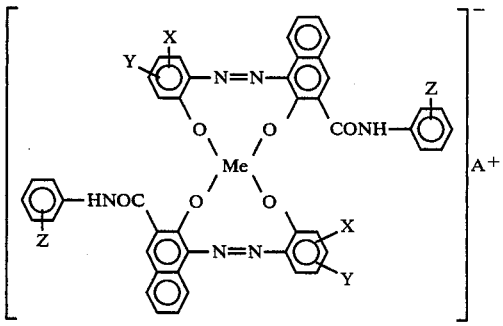

In the formulas, X, Y and Z denote the same or different groups selected from hydrogen, halogen, carboxyl, hydroxyl, nitro, sulfo and sulfamide. In the formula (IV) or (V), at least once of the substituent groups X, Y and Z attached to an aromatic ring should be a hydrophilic functional group as described above.

In the formulas, the counter ion $A^+$ may be $H^+$, $K^+$, $Na^+$, $NH_4^+$ or $Li^+$. Me denotes Cr, Ni, Co, Cu or Zn.

In the dye (B), a plurality of ligands bound to a metal atom can be different but are preferably the same.

Particularly preferred examples of the monoazo dyes (B) include those represented by the following structural formulas B-1 to B-6.

B-1
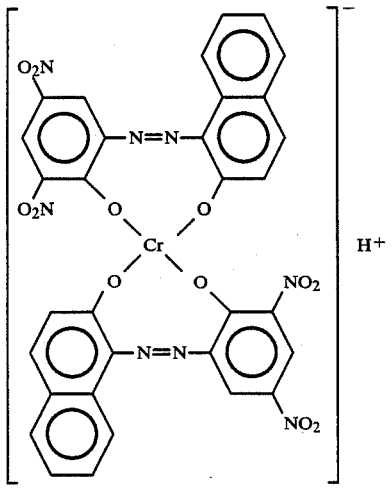
B-2
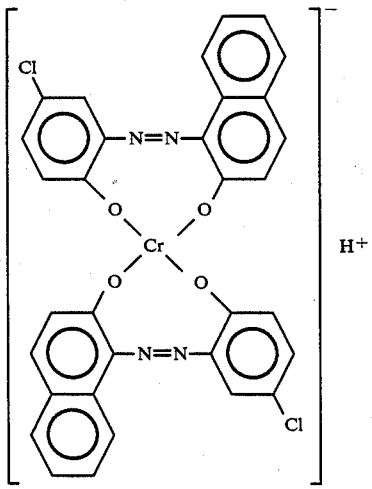
B-3
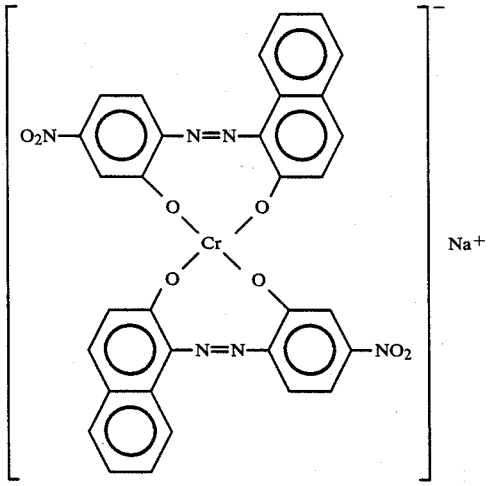

-continued

B-4

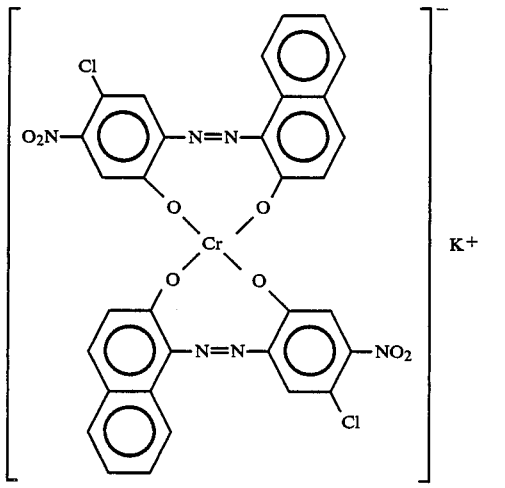

B-5

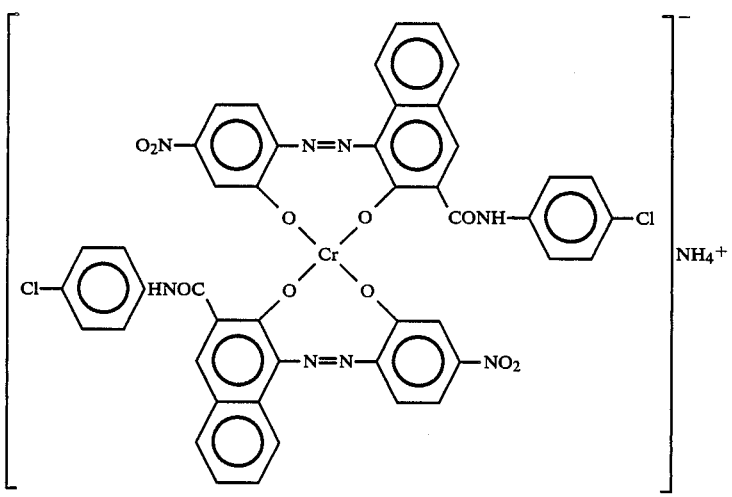

B-6

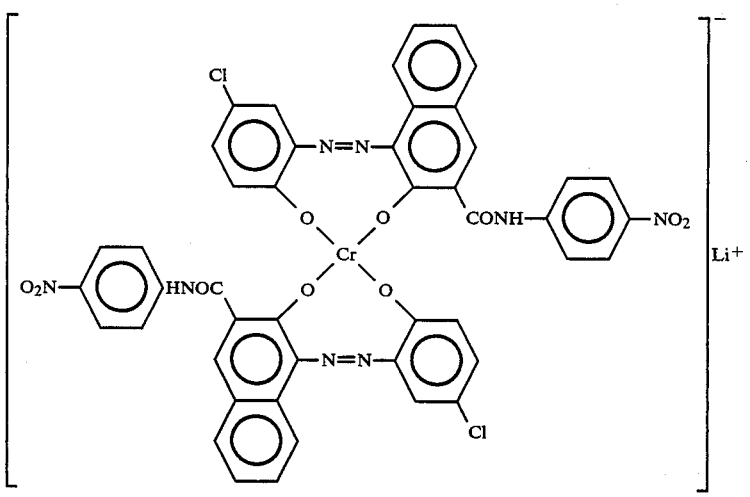

The compound (A) and the dye (B) may preferably be used at a weight ratio of the compound (A)/the dye (B) of 1/10 to 10.0, more preferably 1/3 to 3.0.

The compound (A) and the dye (B) may respectively be added in an amount of preferably 0.1–10.0 wt. parts, more preferably 0.5–4.0 wt. parts, per 100 wt. parts of the binder resin. The total amount of the compound (A) and the dye (B) may preferably be 0.6–5 wt. parts per 100 wt. parts of the binder resin.

The toner of the present invention can be particularly effectively provided as a magnetic toner. The magnetic powder to be incorporated in the toner in this case may be powder of a magnetizable material inclusive of a metal such as Fe, Mi, Co and Mn or an alloy or oxide of these metals. The magnetic powder may preferably have an average particle size of 1 μm or smaller. The magnetic powder may be used in a proportion of 30–150 wt. parts, preferably 30–100 wt. parts, further preferably 50–70 wt. parts, per 100 wt. parts of the binder resin.

The binder resin used in the present invention may be homopolymers of styrene and its derivatives, such as polystyrene, poly-p-chlorostyrene and polyvinyltoluene; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloroacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrileindene copolymer; polyvinyl chloride, polyvinyl acetate, polyester, epoxy resin, polyvinyl butyral, terpene resin, phenolic resin, xylene resin, and aromatic petroleum resin. These resins may be used singly or in mixture.

When the toner is for hot-roller fixation, the binder may preferably comprise a styrene-acrylic resin-type copolymer (inclusive of styrene-acrylic acid ester copolymer and styrene-methacrylic acid ester copolymer. Particularly preferred examples include styrene-n-butyl acrylate (St-nBA) copolymer, styrene-2-ethylhexyl acrylate (St-2EHMA) copolymer, styrene-n-butyl methacrylate (St-nBMA) copolymer, styrene-n-butyl acrylate-2-ethylhexyl methacrylate copolymer (St-nBA-2EHMA) copolymer in view of the developing characteristic and fixing characteristic of the resultant toner.

The toner of the present invention may be generally prepared in the following manner.

(1) The binder resin, the compound (A) and the dye (B) aree blended by uniform dispersion by means of a blender such as Henschel mixer together with optionally added magnetic material or dye or pigment as a colorant.

(2) The above blended mixture is subjected to melt-kneading by using a kneading means such as a kneader, extruder, or roller mill.

(3) The kneaded product is coarsely crushed by means of a crusher such a cutter mill or hammer mill and then finely pulverized by means of a pulverizer such as a jet mill.

(4) The finely pulverized product is subjected to classification for providing a uniform particle size distribution by means of a classifier such as a zigzag classifier, thereby to provide a toner of the present invention.

(5) An external additive such as fine powder of hydrophobic silica, a fluorine-containing resin such as polyvinylidene fluoride, or metal oxide may be added to the classified product, as desired, as a flowability improve or auxiliary charge control agent, and blended by means of a blender such as a Henschel mixer. The hydrophobic silica may preferably be added in a proportion of 0.05–3 wt. parts per 100 wt. parts of the toner. The fluorine-containing resin powder may preferably be added in a proportion of 0.05–3 wt. parts per 100 wt. parts of the toner.

As another process for producing the toner of the present invention, the polymerization process or the encapsulation process can be used. The outline of these processes is summarized as follows.

POLYMERIZATION PROCESS (1) A monomer composition comprising a polymerizable monomer, the compound A and the dye B, (and optionally a polymerization initiator and a colorant) may be dispersed into particles in an aqueous dispersion medium.

(2) The particles of the monomer composition are classified into an appropriate particle size range.

(3) The monomer composition particles whithin a prescribed particle size range after the classification is subjected to polymerization.

(4) After the removal of a dispersant through an appropriate treatment, the polymerized product is filtered, washed with water and dried to obtain a toner.

ENCAPSULATION PROCESS (1) A binder resin, the compound A and the dye B (and optionally a colorant and or magnetic material) is melt-kneaded to form a toner core material in a molten state.

(2) The toner core material is stirred vigorously in water to form fine particles of the core material.

(3) The fine core particles are dispersed in a solution of a shell material, and a poor solvent is added thereto under stirring to coat the core particle surfaces with the shell material to effect encapsulation.

(4) The capsules obtained above are recovered through filtration and drying to obtain a toner.

As described above, according to the present invention, there is provided a toner for dry electrophotography which contains a binder resin and two kinds of charge control agents dispersed therein showing different behaviors with respect to triboelectric charge when contained in the same toner, thereby to show a uniform triboelectric chargeability.

The toner of the present invention exhibits particularly excellent performances when applied to such an electrophotographic process wherein a positively charged latent image is formed on an electrostatic latent image-bearing member such as a selenium photosensitive member; the latent image is developed with an insulating toner having a negative triboelectric charge to form a toner image; the toner image on the latent image bearing member is transferred to a transfer receiving material such as plain paper in the manner of corona transfer by using a low current such as 200±50 μA; and the toner image on the transfer material is fixed under heat and pressure by means of hot rollers.

The toner of the present invention, not only prevents the occurrence of toner scattering at the time of fixing called "tailing" but also provides a toner image with an increased density through improvement in developing characteristic and transfer characteristic of the toner.

The present invention will be explained in further detail by way of Examples.

EXAMPLE 1

| | |
|---|---|
| Styrene-butyl methacrylate copolymer (copolymerization wt. ratio = 75:25) | 100 wt. parts |
| Magnetic powder | 60 " |

-continued

| | |
|---|---|
| (average particle size: 0.3 micron) | |
| Metal complex compound (A) | 2.0 " |
| (structure formula A-1; volume-average particle size ($\overline{d_v}$) = 6.0 μm; number-average particle size ($\overline{d_n}$) = 3.2 μm; volume resistivity (R) = $10^9$ Ω · cm) | |
| Metal complex-type monoazo dye (B) | 1.0 " |
| (structural formula B-5; $\overline{d_v}$ = 5.6 μm, $\overline{d_n}$ = 4.0 μm, R = $10^{10}$ Ω · cm) | |

The above ingredients were melt-kneaded by a roll mill, cooled, pulverized by a jet mill, and classified to obtain a classified product having an average particle size of 9 μm. The classified product in an amount of 100 wt. parts was blended with external additives of 0.4 wt. part of hydrophobic silica (trade name R-972, mfd. by Nippon Aerosil K.K.) and 0.1 wt. part of vinylidene fluoride resin powder by means of a Henschel mixer, thereby to obtain a magnetic toner according to the present invention having a melt index (MI value) of 1.3. The magnetic toner thus obtained showed a negative chargeability when blended with stainless steel balls (particle size: 75 to 150 μm).

The magnetic toner was subjected to a copying test by using a commercially available copying machine (trade name: Selex 802, mfd. by Copier K.K.) having a hot fixing rollers comprising a heating roller coated with polytetrafluoroethylene and a backup roller coated with silicone rubber and heated to surface temperatures of 170°-180° C., a selenium photosensitive member and a stainless steel sleeve. In the copying operation, a DC bias of +200 volts and an AC bias of 1300 volts (Vpp) and 1500 Hz were applied between the selenium photosensitive member and the sleeve, and the developing conditions were controlled so that the selenium photosensitive member had a $V_L$ value of +90 volts and a $V_H$ value of +600 volts. Further, the developed toner image was corona-transferred onto plain paper under the condition of 200 μA and fixed thereon at a linear speed of 200 mm/second. As a result of 1000 sheets of continuous copying test, substantially no scattering of toner called "tailing" was observed on the resultant copies. The image density was 1.28 at time of 500 copies and 1.35 at 1000 copies, which were therefore retained at a high level.

COMPARATIVE EXAMPLE 1

A magnetic toner (MI value=1.6) was prepared in the same manner as in Example 1 except that only the metal complex compound (A) (structural formula A-1) was added in an amount of 3.0 wt. parts. The toner was evaluated in the same manner as in Example 1. The resultant copies showed "flow-tailing" which was more noticeable than in Example 1.

The image density on the copies was 1.06 at 500 copies and 1.10 at 1000 copies, which were lower than those obtained in Example 1.

COMPARATIVE EXAMPLE 2

A magnetic toner (MI value=2.3) was prepared in the same manner as in Example 1 except that only the metal complex salt-type monoazo dye (B) (structural formula B-5) was added in an amount of 3.0 wt. parts. The toner was evaluated in the same manner as in Example 1. The resultant copies showed "explosion-tailing" which was more noticeable than in Example 1.

The image density on the copies was 1.03 at 500 copies and 1.08 at 1000 copies, which were lower than those obtained in Example 1.

EXAMPLE 2

| | |
|---|---|
| Styrene-2-ethylhexyl acrylate-divinylbenzene copolymer | 100 wt. parts |
| (copolymerization wt. ratio = 81:19:1.2) | |
| Magnetic powder | 60 " |
| (the same as used in Example 1) | |
| Metal complex compound (A) | 1.0 " |
| (formula A-2; $\overline{d_v}$ = 7.5 μm; $\overline{d_n}$ = 3.4 μm; R = $10^{11}$ Ω · cm) | |
| Metal complex salt-type monoazo dye (B) | 3.0 wt. parts |
| (formula B-2; $\overline{d_v}$ = 6.5 μm; $\overline{d_n}$ = 4.0 μm; R = $10^{10}$ Ω · cm) | |

The above ingredients were melt-kneaded by a roll mill, pulverized and classified to produce a classified product having an average particle size of 9 μm. The classified product in an amount of 100 wt. parts was blended with external additives of 0.5 wt. part of hydrophobic silica and 0.2 wt. part of vinylidene fluoride resin powder to obtain a magnetic toner (MI=1.9). The toner was then applied to the same copying machine as used in Example 1 for a continuous copying test of 1000 sheets.

Substantially no "tailing" was observed on the resultant copies. The image density was 1.25 at the time of 500 copies and 1.35 at 1000 copies, thus providing a high image density.

COMPARATIVE EXAMPLE 3

A magnetic toner (MI=1.6) was prepared in the same manner as in Example 2 except that only the metal complex salt-type monoazo dye (B) (formula B-2) was used in 4 wt. parts. The toner was evaluated in the same manner as in Example 1 through continuous copying of 1000 sheets. The resultant copies showed "explosion-tailing" which was more noticeable than in Example 2.

The image density on the copies was 1.00 at 500 copies and 1.05 at 1000 copies, which were lower than those obtained in Example 2.

EXAMPLE 3

| | |
|---|---|
| Styrene-n-butyl acrylate-divinylbenzene copolymer | 100 wt. parts |
| (copolymerization wt. ratio = 77:23:0.5) | |
| Magnetic powder | 80 " |
| (average particle size = 0.2 μm) | |
| Metal complex compound (A) | 1.5 " |
| (formula A-3; $\overline{d_v}$ = 6.0 μm, $\overline{d_n}$ = 3.5 μm; R = $10^9$ Ω · cm) | |
| Metal complex salt-type monoazo dye (B) | 1.5 " |
| (formula B-5; $\overline{d_v}$ = 5.3 μm; $\overline{d_n}$ = 4.0 μm; R = $10^{10}$ Ω · cm) | |

The above ingredients were melt-kneaded by a roll mill, pulverized and classified to produce a classified product having an average particle size of 9 μm. The classified product in an amount of 100 wt. parts was blended with external additives of 0.4 wt. part of hydrophobic silica and 0.3 wt. part of vinylidene fluoride resin powder to obtain a magnetic toner (MI=1.8). The toner was then applied to the same copying machine as used in Example 1 for a continuous copying test of 1000 sheets.

Substantially no "tailing" was observed on the resultant copies. The image density was 1.30 at the time of 500 copies and 1.35 at 1000 copies, thus providing a high image density.

COMPARATIVE EXAMPLE 4

A magnetic toner (MI = 1.4) was prepared in the same manner as in Example 2 except that only the metal complex compound (A) (formula A-3) was used in 3.0 wt. parts. The toner was evaluated in the same manner as in Example 3 through continuous copying of 1000 sheets. The resultant copies showed "tailing" which was more noticeable than in Example 3.

The image density on the copies was 1.09 at 500 copies and 1.15 at 1000 copies, which were lower than those obtained in Example 3.

What is claimed is:

1. A dry electrophotographic negatively chargeable one-component type magnetic toner, comprising: a binder resin, magnetic powder, negatively chargeable particles of a metal complex compound (A) of an aromatic hydroxy carboxylic acid having a lipophilic group represented by the formula selected from the group consisting of:

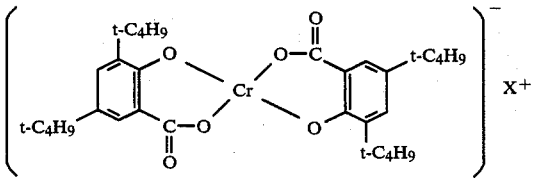

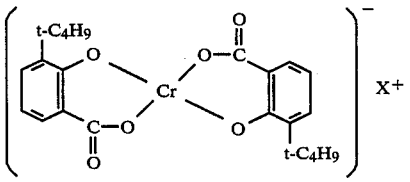

and

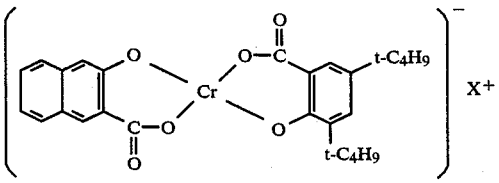

wherein $X^+$ denotes a counter ion, and negatively chargeable particles of a metal complex salt-type monoazo dye (B) having a hydrophilic group represented by the formula selected from the group consisting of

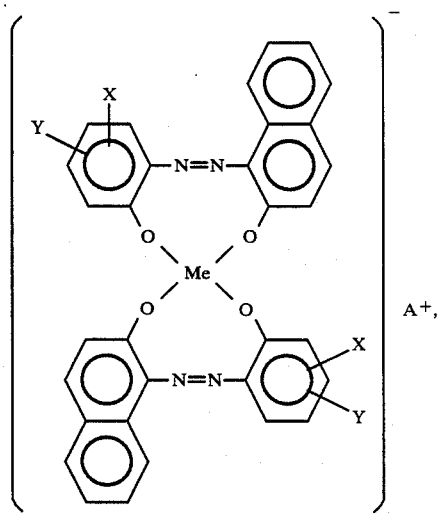

wherein X and Y denotes the same or different groups of hydrogen, halogen, carboxyl, hydroxyl, nitro, sulfo or sulfamide; Me denotes a metal atom; and $A^+$ denotes a counter ion; provided that at least one of the X and Y denotes a group other than hydrogen; and

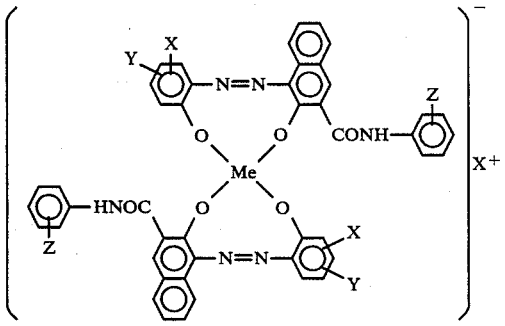

wherein X, Y and Z denote the same or different groups of hydrogen, halogen, carboxyl, hydroxyl, nitro, sulfo or sulfamide; Me denotes a metal atom; and $A^+$ denotes a counter ion; provided that at least one of X, Y and Z denotes a group other than hydrogen; said metal complex compound (A) and monoazo dye (B) being added each in a proportion of 0.1 to 10.0 wt. parts per 100 wt. parts of the binder resin so that they provide a ratio of the compound (A) to the dye (B) in the range of 1/10 to 10.0.

2. A toner according to claim 1, wherein the metal complex compound (A) and the monoazo dye (B) are added so as to provide a ratio of the compound (A)/the dye (B) in the range of 1/3 to 3.0.

3. A toner according to claim 1, wherein the binder resin comprises a styrene-acrylic resin-type copolymer.

4. A toner according to claim 3, wherein said styrene-acrylic resin-type copolymer is selected from the group consisting of styrene-n-butyl acrylate copolymer, styrene-2-ethylhexyl acrylate copolymer, styrene-n-butyl methacrylate copolymer, and styrene-n-butyl acrylate-2-ethylhexyl methacrylate copolymer.

5. A toner according to claim 1, wherein the monoazo dye (B) is a compound represented by the formula:
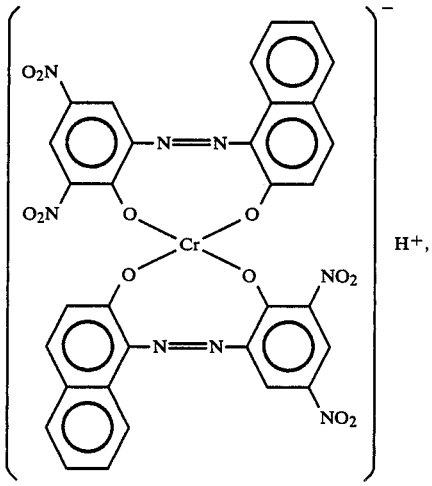
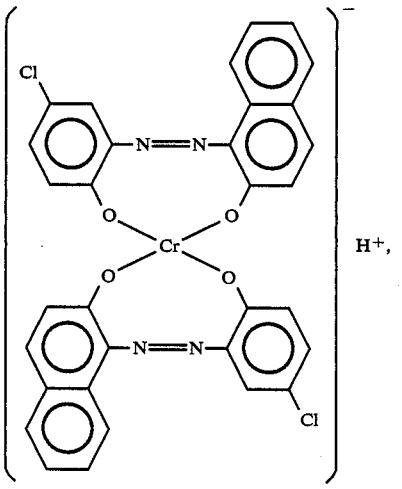
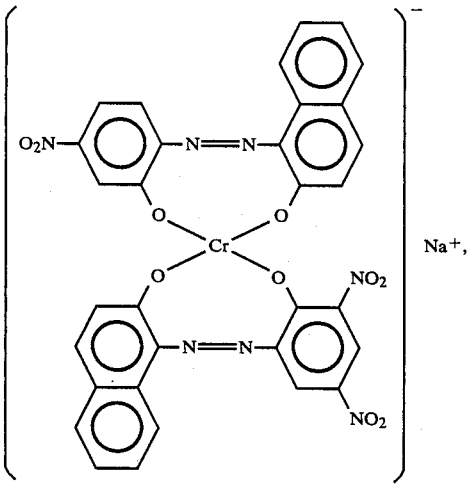

-continued
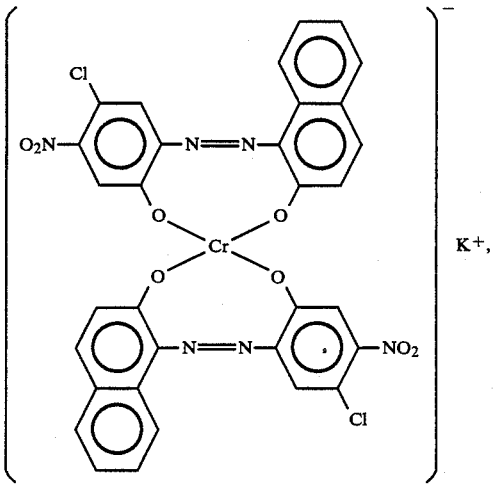
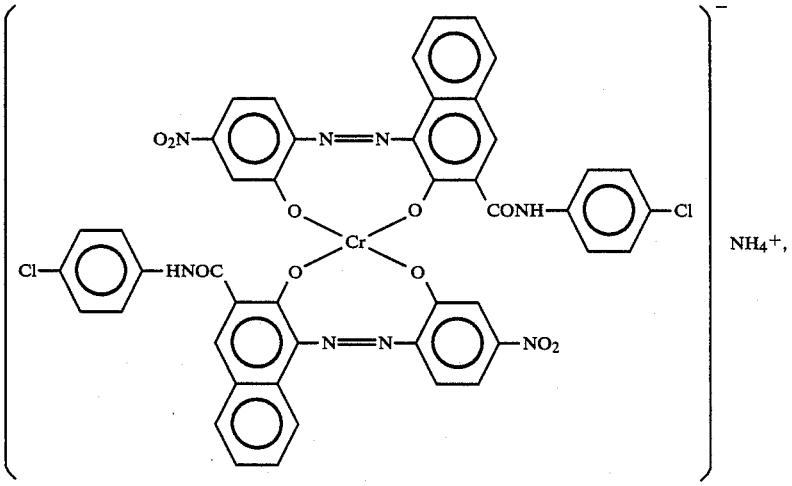
or
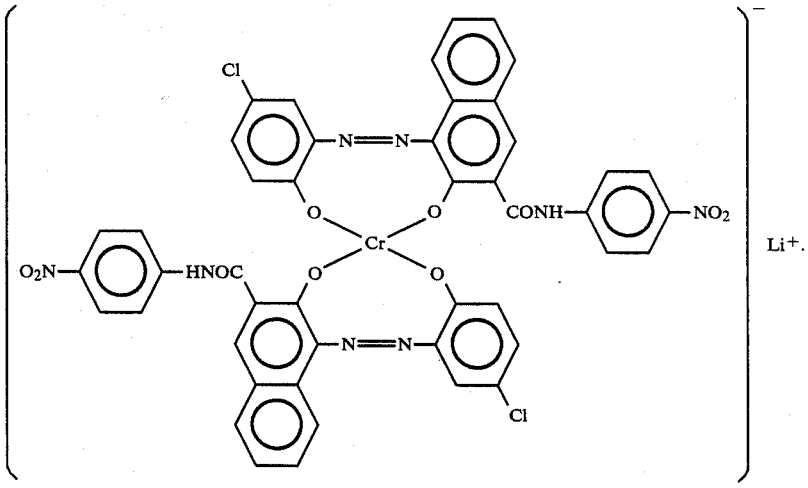
6. A toner according to claim 1, wherein each of the metal complex compound (A) and the monoazo dye (B) is in the form of particles having a volume-average particle size of 9.5 μm or smaller and a number-average molecular weight of 5.0 μm or smaller.

7. A toner according to claim 1, wherein the magnetic powder is contained in a proportion of 30–150 wt. parts per 100 parts of the binder resin.

8. A toner according to claim 7, wherein the magnetic powder is contained in a proportion of 30–100 wt. parts per 100 parts of the binder resin.

9. A toner according to claim 1, which is a negatively chargeable and electrostatically transferable toner.

10. A toner according to claim 1, which is mixed with hydrophobic silica and fluorine-containing resin powder.

11. A toner according to claim 10, wherein the fluorine-containing resin powder comprises polyvinylidene fluoride powder.

12. A toner according to claim 11, wherein the fluorine-containing resin powder is mixed in a proportion of 0.05–3 wt. parts per 100 wt. parts of the toner.

13. A toner according to claim 10, wherein the hydrophobic silica is mixed in a proportion of 0.05–3 wt. parts per 100 wt. parts of the toner.

14. A toner according to claim 1, wherein the counter ion $X^+$ is a cation selected from the group consisting of $H^+$, $K^+$, $Na^+$, $NH_4^+$ and $Li^+$.

15. A toner according to claim 1, wherein said toner is an insulating toner.

* * * * *

UNITED STATES PATENT AND TRADEMARK OFFICE

CERTIFICATE OF CORRECTION

PATENT NO. : 4,873,185

DATED : October 10, 1989

INVENTOR(S) : Mitsuru Uchida, et al.

It is certified that error appears in the above-identified patent and that said Letters Patent is hereby corrected as shown below:

On the title page, Please Add:

--[56] References Cited:

U.S. Patent Documents

| | | | |
|---|---|---|---|
| 2,892,794 | 6/1959 | Insalaco ..... | 430/106 |
| 4,206,064 | 6/1980 | Kiuchi ..... | 430/106 |
| 4,230,787 | 10/1980 | Watanabe ..... | 430/903 |
| 4,258,116 | 3/1981 | Takasu ..... | 430/903 |
| 4,645,729 | 2/1987 | Honda ..... | 430/126 |

Foreign Patent Documents:

45-26478 9/1970.--

[57] ABSTRACT:

Line 6, "enhances" should read --enhance--.

COLUMN 1:

Line 38, "particles" should read --particles)--.

UNITED STATES PATENT AND TRADEMARK OFFICE

CERTIFICATE OF CORRECTION

PATENT NO. : 4,873,185

DATED : October 10, 1989

INVENTOR(S) : Mitsuru Uchida, et al.

It is certified that error appears in the above-identified patent and that said Letters Patent is hereby corrected as shown below:

COLUMN 4:

Line 35, "enhances" should read --enhance--.

Line 49, "volume-average particle size ($d_v$)" should read --volume-average particle size ($\overline{d}_v$)--.

Line 50, "number-average particle size ($d_n$)" should read --volume-average particle size ($\overline{d}_n$)--.

Line 57, "thee" should read --the--.

COLUMN 5:

Formula (II):

" 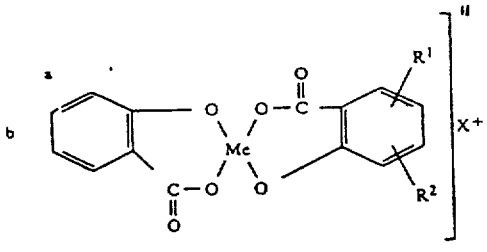 " should read -- 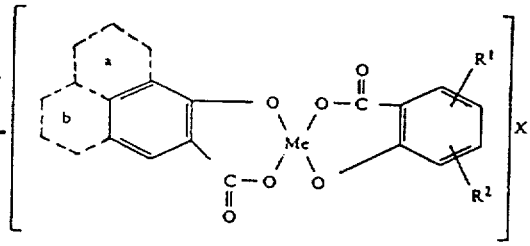 --

UNITED STATES PATENT AND TRADEMARK OFFICE

CERTIFICATE OF CORRECTION

PATENT NO. : 4,873,185 Page 3 of 6

DATED : October 10, 1989

INVENTOR(S) : Mitsuru Uchida, et al.

It is certified that error appears in the above-identified patent and that said Letters Patent is hereby corrected as shown below:

Formula (III)

"

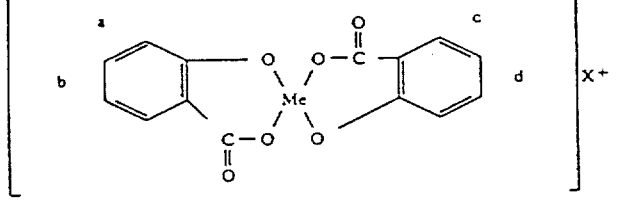

"

should read

--

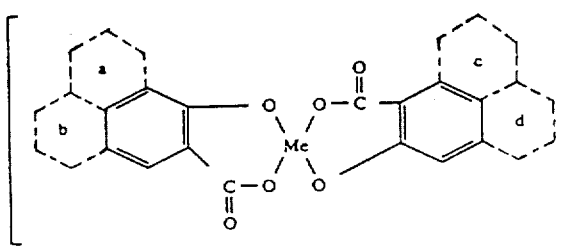

--.

UNITED STATES PATENT AND TRADEMARK OFFICE

CERTIFICATE OF CORRECTION

PATENT NO. :4,873,185 Page 4 of 6

DATED :October 10, 1989

INVENTOR(S) :Mitsuru Uchida, et al.

It is certified that error appears in the above-identified patent and that said Letters Patent is hereby corrected as shown below:

COLUMN 6:

Line 45, "formulas (I)-(III). The" should read --formulas (I)-(III), the--

Formula A-1:

"

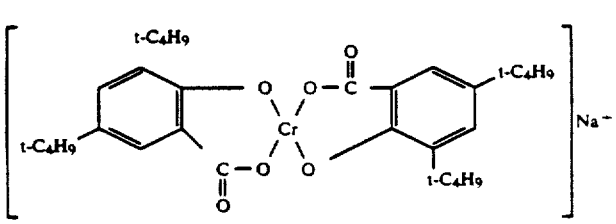

A-1 "

should read

--

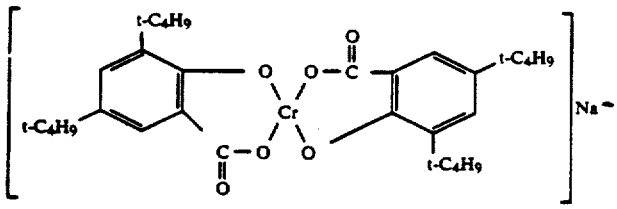

A-1

--.

UNITED STATES PATENT AND TRADEMARK OFFICE

CERTIFICATE OF CORRECTION

PATENT NO. : 4,873,185

DATED : October 10, 1989

INVENTOR(S) : Mitsuru Uchida, et al.

It is certified that error appears in the above-identified patent and that said Letters Patent is hereby corrected as shown below:

COLUMN 7:

Line 15, add --A-3-- next to formula.

COLUMN 8:

Line 59, "once" should read --one--.

COLUMN 13:

Line 33, "copolymer" should read --copolymer)--.

Line 44, "aree" should read --are--

COLUMN 14:

Line 16, "whithin" should read --within--

COLUMN 17:

Line 38, after "$X^+$" insert --, (comma)--.

UNITED STATES PATENT AND TRADEMARK OFFICE

CERTIFICATE OF CORRECTION

PATENT NO. : 4,873,185 Page 6 of 6

DATED : October 10, 1989

INVENTOR(S) : Mitsuru Uchida, et a l

It is certified that error appears in the above-indentified patent and that said Letters Patent is hereby corrected as shown below:

COLUMN 19: Lines 49 to 67

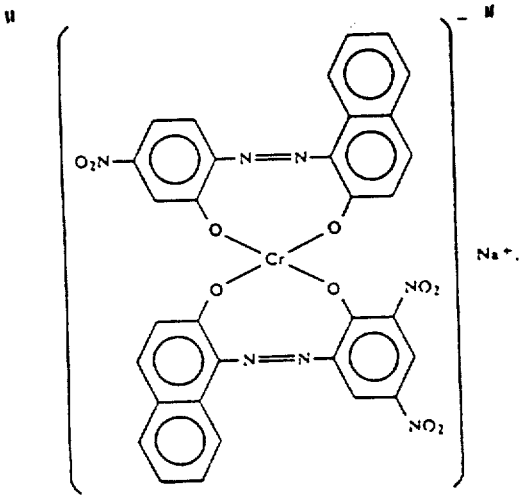

should read --

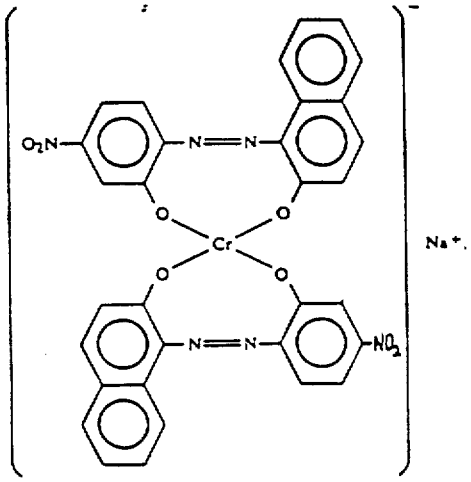

Signed and Sealed this

Twelfth Day of April, 1994

Bruce Lehman

BRUCE LEHMAN

*Commissioner of Patents and Trademarks*

*Attest:*

*Attesting Officer*